US006634567B2

(12) United States Patent
Hotta et al.

(10) Patent No.: US 6,634,567 B2
(45) Date of Patent: Oct. 21, 2003

(54) EXPANSION VALVE UNIT HAVING PRESSURE DETECTING FUNCTION

(75) Inventors: Teruyuki Hotta, Aichi (JP); Shigeki Ito, Aichi (JP); Yasushi Yamanaka, Aichi (JP); Ryo Matsuda, Tokyo (JP); Kazuhiko Watanabe, Tokyo (JP); Keiji Sasaki, Tokyo (JP)

(73) Assignees: Denson Corporation, Aichi (JP); Fujikoki Corporation, Tokyo (JP)

( * ) Notice: Subject to any disclaimer, the term of this patent is extended or adjusted under 35 U.S.C. 154(b) by 0 days.

(21) Appl. No.: 10/173,078

(22) Filed: Jun. 18, 2002

(65) Prior Publication Data

US 2003/0010833 A1 Jan. 16, 2003

(30) Foreign Application Priority Data

Jun. 19, 2001 (JP) ..... 2001-185389
Apr. 11, 2002 (JP) ..... 2002-109718

(51) Int. Cl.[7] ..... G05D 27/00; F25B 41/04
(52) U.S. Cl. ..... 236/92 B; 62/222; 62/210
(58) Field of Search ..... 62/210, 211, 222, 62/225, 223, 224; 236/92 B

(56) References Cited

U.S. PATENT DOCUMENTS 4,827,094 A 5/1989 Tanaka et al. ..... 200/83 J
4,853,504 A 8/1989 Tanaka et al. ..... 200/83 P
5,996,900 A 12/1999 Ise ..... 236/92 B
6,176,137 B1 1/2001 Sasaki et al. ..... 73/754
6,233,956 B1 * 5/2001 Katayama et al. ..... 62/197

FOREIGN PATENT DOCUMENTS

| | | |
|---|---|---|
| JP | UM55-144268 | 4/1979 |
| JP | 7-101583 | 11/1995 |
| JP | 11-351990 | 12/1999 |
| JP | 2000-220917 | 8/2000 |

* cited by examiner

*Primary Examiner*—William E. Tapolcai
(74) *Attorney, Agent, or Firm*—Rader, Fishman & Grauer PLLC

(57) ABSTRACT

An expansion valve unit having a pressure detecting function includes a supercooling control expansion valve disposed in a flow path of a refrigerant sent into an evaporator of a refrigeration system constituting a refrigerating cycle to control the flow rate of the refrigerant. A pressure detector is provided at one end of the supercooling control expansion valve to detect the pressure of the refrigerant sent thereto through a passage in the expansion valve. The supercooling control expansion valve and the pressure detector are integrated with each other by a joining means.

8 Claims, 7 Drawing Sheets

EXPANSION VALVE UNIT HAVING PRESSURE DETECTING FUNCTION

BACKGROUND OF THE INVENTION

1. Field of the Invention

The present invention relates to a supercooling control expansion valve having a pressure detecting function for use in a refrigerating cycle. More particularly, the present invention relates to a supercooling control expansion valve unit having a pressure detecting function, in which a pressure detector is integrally joined to a supercooling control expansion valve.

2. Description of the Related Art

Thermostatic expansion valves are widely employed as expansion valves for use in refrigerating cycles. Supercooling control expansion valves are also used in refrigerating cycles as expansion valves that control the flow rate of a refrigerant entering an evaporator by detecting the degree of supercooling of the high-pressure refrigerant before it is sent into the evaporator. It is known that the use of a supercooling control expansion valve allows the whole system to be constructed in a compact form. A supercooling control expansion valve is incorporated in a refrigerating cycle comprising a compressor, a condenser for condensing a high-pressure refrigerant, a pressure-reducing device for reducing the pressure of the condensed refrigerant, an evaporator for evaporating the refrigerant after the pressure reduction, an accumulator, and so forth. The supercooling control expansion valve is placed upstream of the evaporator.

Meanwhile, the refrigerating cycle is provided with a sensor for detecting the pressure of the refrigerant and outputting the quantity of state thereof in the form of an electric signal to control the function of the refrigerating cycle normally. Examples of the detecting sensor include a pressure sensor and a pressure switch having electric contacts. Japanese Patent Application Unexamined Publication (KOKAI) No. Hei 11-351990 proposes a pressure sensor adopting an absolute pressure method or a sealed gauge pressure method as a detecting sensor usable in a refrigerating cycle.

Thus, various devices have been developed and proposed as individual units. However, these devices are incorporated into the above-described refrigerating cycle as discrete component parts in the present state of the art. The assembly of the discrete component parts needs an unfavorably large number of man-hours for piping work and so forth. When these component parts are used in the refrigerating cycle of air-conditioning systems installed in motor vehicles or the like in particular, the component parts are generally manufactured by mass production. Therefore, the number of man-hours needed for the assembly inevitably increases in proportion to the production output, and the parts count (i.e. the number of constituent parts) also increases. Accordingly, there are demands that the assembly man-hours and the parts count should be minimized.

To meet these demands, Japanese Utility Model Application Unexamined Publication (KOKAI) No. Sho 55-144268 proposes a pressure switch-incorporating expansion valve unit comprising a pressure switch and an expansion valve combined together into one unit. The pressure switch-incorporating expansion valve unit is expected to save piping and to simplify the assembly operation. However, a diaphragm for driving the valve element of the pressure switch-incorporating expansion valve unit responds to the evaporator outlet-side refrigerant supplied thereinto through a pipe. In addition, the diaphragm and the casing of a pressure switch for detecting the pressure of the evaporator outlet-side refrigerant are placed away from each other.

Therefore, the detection of the refrigerant pressure is performed separately at two positions, i.e. at the position of the pressure switch and at the position of the diaphragm for driving the valve element. Thus, the temperature response characteristics of the two pressure detections do not match to each other because the detections are made at different positions. Accordingly, the temperature response of the system is not very fast.

SUMMARY OF THE INVENTION

The present invention has been developed with the above-described technical background to attain the following objects.

An object of the present invention is to provide an expansion valve unit having a pressure detecting function that is made compact by integrally incorporating a pressure detector into a supercooling control expansion valve.

Another object of the present invention is to provide an expansion valve unit having a pressure detecting function that is reduced in the number of man-hours needed for incorporation into a refrigerating cycle by combining together a supercooling control expansion valve and a pressure detector into one unit.

A further object of the present invention is to provide an expansion valve unit having a pressure detecting function that is reduced in the parts count to minimize the production cost.

A further object of the present invention is to provide an expansion valve unit having a pressure detecting function that is improved in the response for pressure detection of the expansion valve.

A further object of the present invention is to provide an expansion valve unit having a pressure detecting function in which the response characteristics of the refrigerant pressure detector and the response characteristics for pressure detection of the expansion valve are matched to each other.

According to a first aspect of the present invention, there is provided an expansion valve unit having a pressure detecting function. The expansion valve unit includes a supercooling control expansion valve disposed in a flow path of a refrigerant sent into an evaporator of a refrigeration system constituting a refrigerating cycle to control the flow rate of the refrigerant. A pressure detector is provided at one end of the supercooling control expansion valve to detect the pressure of the refrigerant sent thereto through a refrigerant passage in the supercooling control expansion valve. The pressure detector is integrally joined to the supercooling control expansion valve by a joining means. A hermetic seal member is disposed near the joint between the supercooling control expansion valve and the pressure detector to prevent leakage of the refrigerant. A hermetically sealed space is formed in a block constituting the base body of the supercooling control expansion valve. The hermetically sealed space surrounds a flow rate control member incorporated in the supercooling control expansion valve and communicates with the refrigerant passage.

According to a second aspect of the present invention, there is provided an expansion valve unit having a pressure detecting function. The expansion valve unit includes a supercooling control expansion valve disposed in a flow path of a refrigerant sent into an evaporator of a refrigeration system constituting a refrigerating cycle to control the flow rate of the refrigerant. A pressure detector is provided at one end of the supercooling control expansion valve to detect the pressure of the refrigerant sent thereto through a refrigerant passage in the supercooling control expansion valve. The pressure detector is integrally joined to the supercooling control expansion valve by a joining means. A hermetic seal member is disposed near the joint between the supercooling control expansion valve and the pressure detector to prevent leakage of the refrigerant. A power element chamber is provided in a block constituting the base body of the supercooling control expansion valve. The power element chamber is defined by a diaphragm and has a refrigerant sealed therein to control the degree of opening of a valve element of the supercooling control expansion valve. A first space is formed adjacently to the power element chamber. The first space communicates with the refrigerant passage. The first space is filled with a high-temperature and high-pressure refrigerant and disposed closer to the pressure detector than the power element chamber. A second space is formed adjacently to the first space on the side thereof closer to the pressure detector. The pressure detector is disposed between the first space and the second space to detect the pressure of the high-temperature and high-pressure refrigerant on the basis of a pressure difference between the first space and the second space.

In the expansion valve unit having a pressure detecting function according to the first or second aspect of the present invention, the hermetic seal member should preferably be an O-ring for sealing the gap between the pressure detector and the block.

In the expansion valve unit having a pressure detecting function according to the first or second aspect of the present invention, the pressure detector should preferably detect the pressure of the refrigerant with a pressure detecting device comprising a semiconductor device.

In the expansion valve unit having a pressure detecting function according to the first or second aspect of the present invention, the pressure detector should preferably detect the pressure of the refrigerant with a contact type pressure switch.

In the expansion valve unit having a pressure detecting function according to the first or second aspect of the present invention, the joining means should preferably be caulking whereby the block is plastically deformed.

In the expansion valve unit having a pressure detecting function according to the first or second aspect of the present invention, the joining means should preferably be thread coupling wherein the pressure detector is fixed to the supercooling control expansion valve by thread engagement.

In the expansion valve unit having a pressure detecting function according to the first or second aspect of the present invention, the thread coupling should preferably be such that the pressure detector is fixed to the block by engagement between a nut having an internal thread and an external thread provided on the outer periphery of the block.

The above and other objects, features and advantages of the present invention will become more apparent from the following description of the preferred embodiments thereof, taken in conjunction with the accompanying drawings.

DETAILED DESCRIPTION OF THE PREFERRED EMBODIMENTS (First Embodiment)

Figure 1:
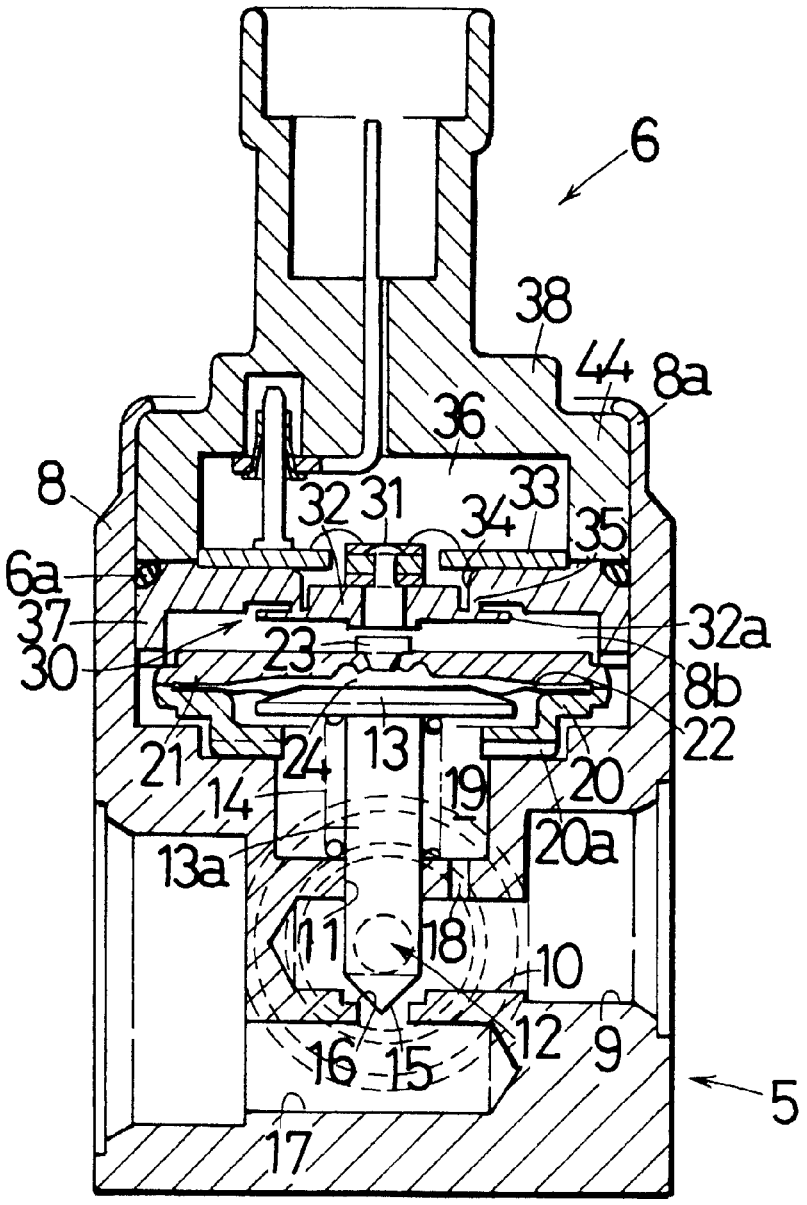
FIG. 1 is a sectional view showing the general structure of an expansion valve unit having a pressure detecting function according to the present invention.
Figure 2:
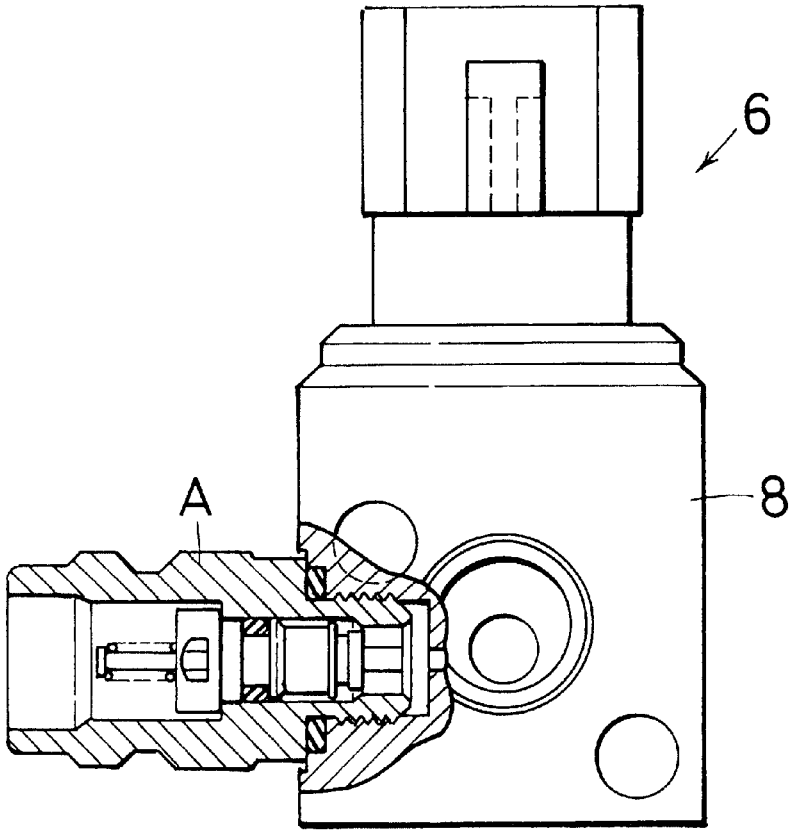
FIG. 2 is a partly-sectioned side view of FIG. 1, showing the external appearance of the expansion valve unit as equipped with a charge valve.
Figure 3:
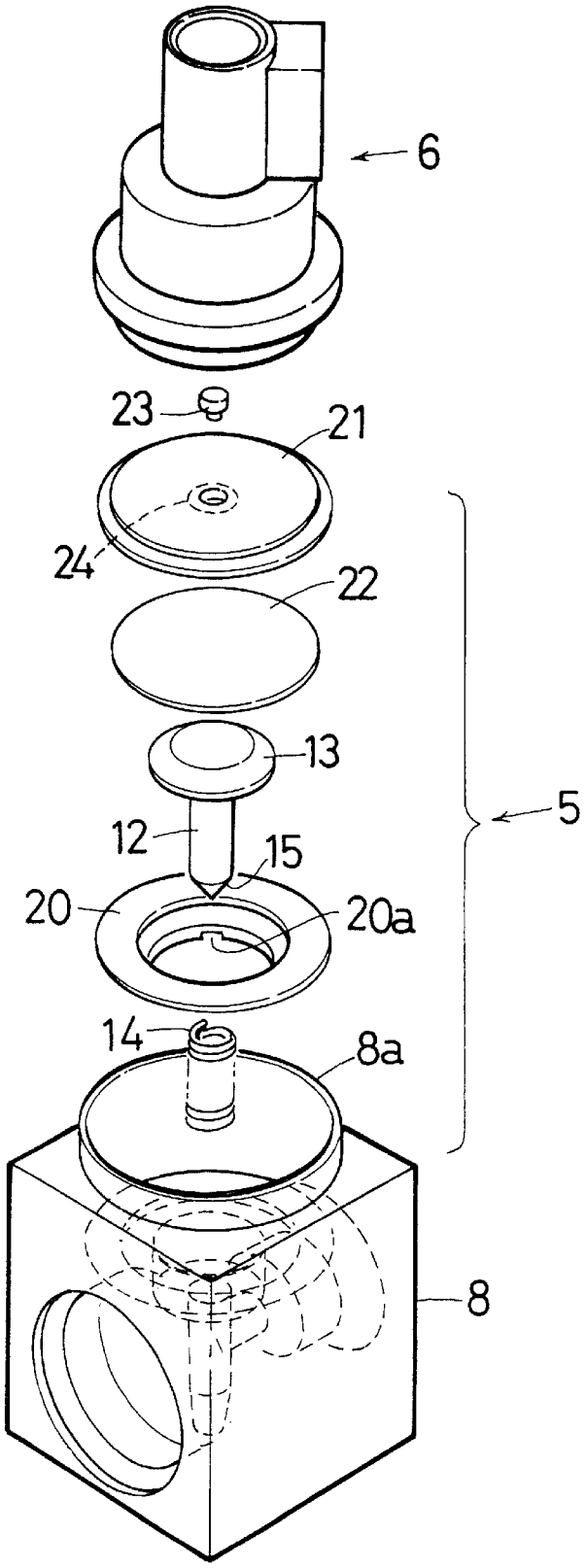
FIG. 3 is an exploded view of constituent parts, three-dimensionally illustrating the arrangement of the expansion valve unit shown in FIG. 1.
Figure 4:
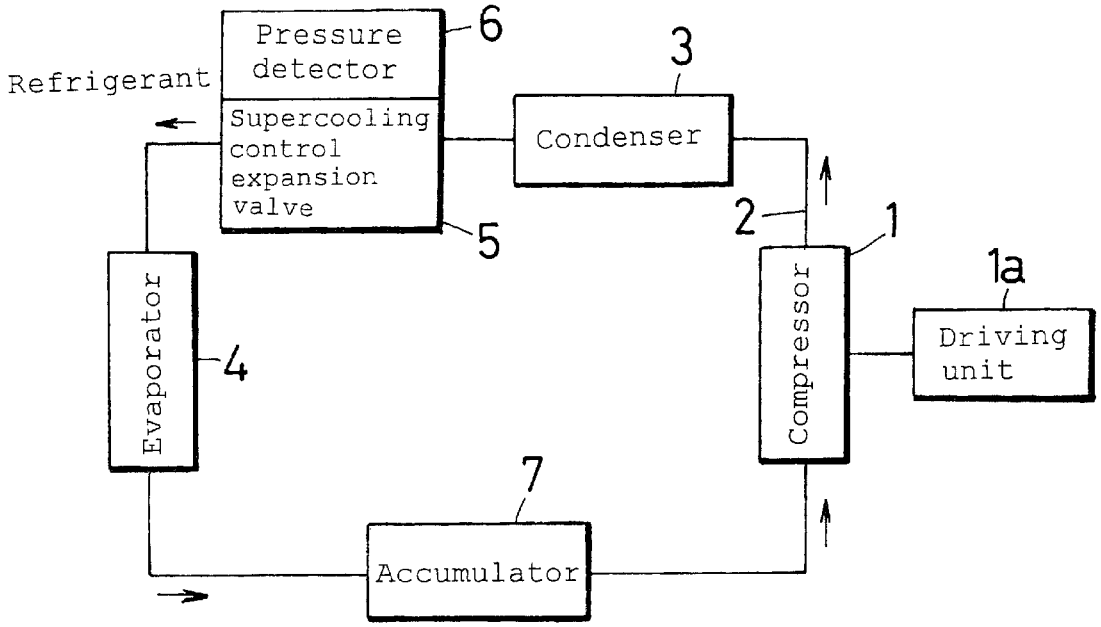
FIG. 4 is a block diagram showing a refrigerating cycle to which the expansion valve unit according to the present invention is applied.

A first embodiment of the present invention will be described below. FIG. 1 is a sectional view showing the general structure of an expansion valve unit having a pressure detecting function according to the present invention. FIG. 2 is a side view of FIG. 1, showing the external appearance of the expansion valve unit as equipped with a charge valve. FIG. 3 is an exploded view of constituent parts, three-dimensionally illustrating the expansion valve unit shown in FIG. 1. FIG. 4 is a block diagram showing a refrigerating cycle to which the expansion valve unit according to the present invention is applied.

Let us describe the refrigerating cycle shown in FIG. 4 first. A refrigerant is compressed to a high pressure by a compressor 1. The compressed refrigerant is introduced into a condenser 3 through refrigerant piping 2. The refrigerant used in this embodiment is HFC-134a. The compressor 1 is driven by a driving unit 1*a,* e.g. an engine or an electric motor. In the case of a motor vehicle, for example, the driving unit 1*a* is an engine, although this is not shown in the figure. The engine is connected to the compressor 1 through a chain or a belt to drive the compressor 1 rotationally.

The refrigerant introduced into the condenser 3 is condensed and thus liquefied. Subsequently, the refrigerant is sent into an evaporator 4 after the flow rate of the refrigerant has been controlled through an expansion valve as a pressure-reducing device, more specifically, through a supercooling control expansion valve 5. Elaborate control including the supercooling control expansion valve 5 is indispensable for the refrigerating cycle when used as an automotive air-conditioning system, in particular, because environmental conditions, e.g. temperature and humidity inside and outside the vehicle, vary complicatedly over wide ranges, and the engine speed also varies to a considerable extent. The supercooling control expansion valve 5 performs flow rate control according to the change in temperature as one of cooling capacity control operations.

Meanwhile, a pressure detector 6 is incorporated in the refrigerating cycle to serve as a sensor for detecting an abnormally high pressure or an abnormally low pressure that may occur in the refrigerating cycle and for controlling the control system upon detecting such an abnormally high or low pressure. For example, if the delivery pressure of the refrigerant is high and the refrigerant discharge temperature becomes high, the heat exchanging capacity degrades. In view of these circumstances, the pressure detector 6 controls the control system such that when the refrigerant pressure in the refrigerating cycle is within a normal pressure range, the pressure switch is set in an ON state, whereas when the refrigerant pressure is lower or higher than the normal pressure range, the pressure switch is set in an OFF state. Further, the pressure detector 6 ON-OFF controls a fan motor of the condenser 3, etc.

The refrigerant after the pressure reduction is introduced into an evaporator 4 for endothermic evaporation. Air is cooled by the heat exchanging operation of the evaporator 4, and cool air is sent into the inside of the vehicle by a fan (not shown) to effect air-conditioning. The refrigerant passing through the evaporator 4 is introduced into an accumulator 7 as a saturated liquid. The refrigerant from the accumulator 7 is sucked into the compressor 1 and then delivered to the condenser 3 again, thus forming a refrigerating cycle.

Next, a specific arrangement of the supercooling control expansion valve unit having a pressure detecting function according to the present invention will be described in detail. FIG. 1 shows the arrangement of a supercooling control expansion valve 5 integrally equipped with a pressure detector 6 as an example of an expansion valve unit for use in the refrigerating cycle of an automotive air-conditioning system or the like. The supercooling control expansion valve 5 has a block 8 constituting a base body thereof. The high-pressure refrigerant is sent into the block 8 from the condenser 3 upstream of the expansion valve 5. The block 8 has a substantially cubic configuration. A side of the block 8 on which the pressure detector 6 is mounted is partially recessed in a circular cylindrical shape.

The basic structure and function of the supercooling control expansion valve 5 are detailed in Japanese Patent Application Unexamined Publication (KOKAI) No. 2000-220917 and not concerned with the gist of the present invention. Therefore, a detailed description thereof is omitted herein. In the following, only the structure of the supercooling control expansion valve 5 that is concerned with the present invention will be described in detail. The high-pressure refrigerant is introduced into the expansion valve 5 from a refrigerant passage 9 formed in the block 8 as an inlet for receiving the refrigerant from the condenser 3.

A piping member is installed in the refrigerant passage 9. A passage hole 10 is formed in the refrigerant passage 9. The passage hole 10 extends to a central portion of the block 8. A valve rod guide hole 11 is formed in the central portion of the block 8 to intersect the passage hole 10 at right angles. The passage hole 10 and the valve rod guide hole 11 are in communication with each other. As shown in FIG. 2, a charge valve A is provided on one side of the block 8 in communication with the refrigerant passage 9.

A valve rod 12 is axially movably fitted in the valve rod guide hole 11. The valve rod 12 has a diaphragm retaining disk 13 at one end thereof. The diaphragm retaining disk 13 is formed from an enlarged-diameter portion of the valve rod 12. Further, the valve rod 12 has an underhead portion 13*a* formed by a reduced-diameter portion thereof that is integral with the diaphragm retaining disk 13. A coil spring 14 is fitted on the outer periphery of the underhead portion 13*a*. The coil spring 14 constantly urges the valve rod 12 toward the diaphragm retaining disk 13 side. The other end of the valve rod 12 is formed with a conical valve element 15 that faces a valve seat hole 16 provided in the block 8. The valve seat hole 16 is in communication with a passage 17 leading to the evaporator 4.

Further, the block 8 is provided with a small hole 18 serving as a refrigerant passage extending parallel to the valve rod 12. The small hole 18 provides communication between the passage hole 10 and a coil spring accommodating space 19. The diaphragm retaining disk 13 is disposed in a space defined between a diaphragm support member 20 and a diaphragm holding member 21.

A disk-shaped diaphragm 22 is made of a flexible thin membrane. The outer peripheral portion of the diaphragm 22 is held between the diaphragm support member 20 and the diaphragm holding member 21 and rigidly combined therewith into one unit by welding them together so that the refrigerant will not leak to the outside.

The end face of the diaphragm retaining disk 13 abuts against a central portion of the diaphragm 22. The diaphragm support member 20, the diaphragm holding member 21 and the diaphragm 22 may be formed into one unit by pressing, with the diaphragm retaining disk 13 inserted therein. The diaphragm support member 20 has a plurality of slit grooves 20*a* at equiangular positions on a lower surface portion (as viewed in the figures) that abuts against the block 8.

The slit grooves 20*a* serve as a flow path for passing the refrigerant from the passage hole 10, the small hole 18 and the coil spring accommodating space 19. The slit grooves 20*a* constitute a part of a passage for introducing the refrigerant to the pressure detector 6 side. The diaphragm holding member 21 has a recess formed on the inner side of a central portion thereof. A gas is sealed in between the recess and the diaphragm 22. After the gas has been sealed in the recess, a gas injection port is sealed with a button 23 to form a power element chamber 24. The gas in the power element chamber 24 expands or contracts according to the ambient temperature.

The sealed-in gas is preferably a gas exhibiting a high response to temperature changes, e.g. R404*a*, R407, or R22. The supercooling control expansion valve 5 is arranged as detailed above. The pressure detector 6 (described later) is fixedly disposed above (as viewed in the figures) the diaphragm holding member 21. The pressure detector 6 is inserted and fixed in a cylindrical space formed in the block 8 from one side thereof, thus forming a supercooling control expansion valve unit having a pressure detecting function according to the present invention.

The pressure detector 6 inserted into the cylindrical space in the block 8 is fixed by inwardly deforming a thin-walled distal end portion 8*a* (joining means) of the block 8 with a caulking tool (not shown). The thin-walled distal end portion 8*a* presses a step portion 44 of a casing 38 of the pressure detector 6 to join together the supercooling control expansion valve 5 and the pressure detector 6 into one unit. To maintain gas-tightness between the block 8 and the pressure detector 6, an O-ring 6*a* serving as a hermetic seal member is disposed on a corner portion of a sensor element holder 37 (described later). In this arrangement, the refrigerant from the upstream side is introduced into the coil spring accommodating space 19 through the passage hole 10 and the small hole 18 in the block 8. The introduced refrigerant further passes through the slit grooves 20*a* and is introduced to the pressure detector 6 side through a passage space 8*b* in the block 8.

Thus, a passage space 8*b* is also provided on the side of the power element chamber 24 closer to the pressure detector 6, and the high-temperature and high-pressure refrigerant before the pressure reduction is introduced into the passage space 8*b*. Consequently, the high-temperature and high-pressure refrigerant surrounds the entire periphery of the power element chamber 24. Accordingly, the conductivity of heat to the gas sealed in the power element chamber 24 is improved, and hence the temperature response of the diaphragm 22 becomes favorably high.

As the high-temperature and high-pressure refrigerant flows through the block 8, the pressure of the gas sealed in the power element chamber 24 varies according to the pressure and temperature of the refrigerant. The pressure change is balanced with the force pressing the diaphragm retaining disk 13 through the diaphragm 22 and the biasing force of the coil spring 14. Consequently, the diaphragm retaining disk 13 is held at a predetermined position. The change in the position of the diaphragm retaining disk 13 causes the valve element 15 of the valve rod 12 to change the sectional area for passing the refrigerant defined between the valve element 15 and the valve seat hole 16. Thus, the amount of refrigerant passing between the valve element 15 and the valve seat hole 16 is changed according to the position where the diaphragm retaining disk 13 is held. In this way, the flow rate of the refrigerant is controlled.

That is, when the temperature of the refrigerant on the upstream side rises, the pressure in the power element chamber 24 increases, causing the valve element 15 to move in the valve-closing direction. As a result, the amount of refrigerant delivered reduces, and hence the degree of supercooling of the refrigerant on the upstream side increases. Conversely, when the refrigerant temperature on the upstream side lowers, the system operates in reverse to the above. In this way, the degree of supercooling of the high-pressure refrigerant on the upstream side is controlled. Meanwhile, the refrigerant introduced into the passage space 8*b* is sent to the pressure detector 6 installed in the cylindrical space in the block 8.

Next, the pressure detector 6 will be described. The basic subject matter of the pressure detector 6 is detailed in Japanese Patent Application Unexamined Publication (KOKAI) No. Hei 11-351990. The invention disclosed in this publication is a pressure sensor adopting an absolute pressure method or a sealed gauge pressure method. Either of the methods is chosen according to service environmental conditions, required tolerances and so forth.

The pressure detector 6 contains a sensor element 30 having a pressure detecting device 31, which is a semiconductor device having a piezoresistance effect. The sensor element 30 is fixedly disposed in an opening 34 provided in the center of a cylindrical sensor element holder 37. The pressure detecting device 31 of the sensor element 30 is supported by a support plate 32. The outer periphery of the support plate 32 has a thin-walled collar portion 32*a*.

An annular projection 35 is formed on the outer periphery of the opening 34 in the sensor element holder 37. The collar portion 32*a* abuts against the annular projection 35. The collar portion 32*a* and the annular projection 35 are gas-tightly fixed together by welding. Accordingly, the passage space 8*b*, which is a space between the sensor element holder 37 and the diaphragm holding member 21, and a space 36 defined between the sensor element 30 and the casing 38, are not in communication with each other. Therefore, the passage space 8*b* and the space 36 are different in pressure from each other.

The space 36 is a closed space kept under the atmospheric pressure. The refrigerant introduced through the passage space 8*b* reaches the pressure detecting device 31 through the opening 34 in the center of the sensor element holder 37. Thus, a differential pressure between the passage space 8*b* and the space 36 is detected. The pressure detector 6 performs pressure detection on the basis of a pressure difference between the passage space 8*b* and the space 36.

The passage space 8*b* serves as both a space for the pressure detector 6 and a passage for improving the temperature response of the power element chamber 24. Accordingly, the block 8, which constitutes the base body of the supercooling control expansion valve 5, can be made compact in size, advantageously, in comparison to an arrangement in which a passage space 8*b* for pressure detection and another passage space 8*b* for improving the temperature response of the power element chamber 24 are provided at different positions.

In addition, the pressure detector 6 is fixed to the block 8 in such a manner that gas-tightness between the pressure detector 6 and the supercooling control expansion valve 5 is maintained by the O-ring 6*a* and so forth. Therefore, there is no likelihood that the refrigerant may leak to the block 8. Moreover, the pressure is detected precisely.

In the first embodiment, the sensor element 30 is disposed in the center of the sensor element holder 37. However, the sensor element 30 may be arranged in a variety of forms and is not necessarily limited to the above-described example of arrangement. The pressure detector 6 is joined to the block 8 as follows. After the sensor element holder 37, the O-ring 6*a* and the casing 38 have been inserted into the block 8, the thin-walled distal end portion 8*a* of the cylindrical part of the block 8 is deformed inwardly by caulking in such a manner as to hold the step portion 44 of the casing 38 therein so that the pressure detector 6 will not become dislodged. Thus, the supercooling control expansion valve 5 and the pressure detector 6 are joined together into one unit by using the thin-walled distal end portion 8*a* as a joining member.

The joining made by caulking provides a reliable joint without the danger of dislodging of the pressure detector 6 due to vibrations even when the supercooling control expansion valve unit is installed on the body of a vehicle such as an automobile. In the case of joining by caulking, the pressure detector 6 cannot be detached from the block 8. Although the above-described caulking is carried out by deforming the thin-walled distal end portion 8*a* of the block 8 with respect to the pressure detector 6, a portion of the pressure detector 6 may be caulked to the block 8.

Thus, the supercooling control expansion valve unit according to the present invention can be handled as a unitized set of component parts and replaced in the form of a complete set of parts. Accordingly, it is possible to deal with trouble readily by replacing the complete set of parts. Therefore, there is no problem in terms of the replacement of parts despite the caulked component parts. Further, the O-ring 6*a* is provided as a seal member on the outer periphery of the sensor element holder 37. When the sensor element holder 37 is inserted into the block 8, the O-ring 6*a* abuts against the inner peripheral portion of the cylindrical part of the block 8 to maintain gas-tightness and to form the passage space 8*b* and the gas-tight space 36.

However, the hermetic seal member used in the present invention is not necessarily limited to the O-ring 6*a*. For example, an elastic ring with an X-shaped sectional configuration may be used as the hermetic seal member. It is also possible to use a member known as "packing". The refrigerant sent to the block 8 is then sent into the expansion valve through the small hole 18, the coil spring accommodating space 19, the slit grooves 20*a* formed in the diaphragm support member 20 and the passage space 8*b*, causing the valve rod 12 to move in response to changes in pressure and temperature. In this way, flow rate control is performed on the expansion valve side, and the pressure of the refrigerant is detected on the pressure detector side. Thus, the supercooling control expansion valve unit attains two functions integrally.

(Second Embodiment)

Figure 5:
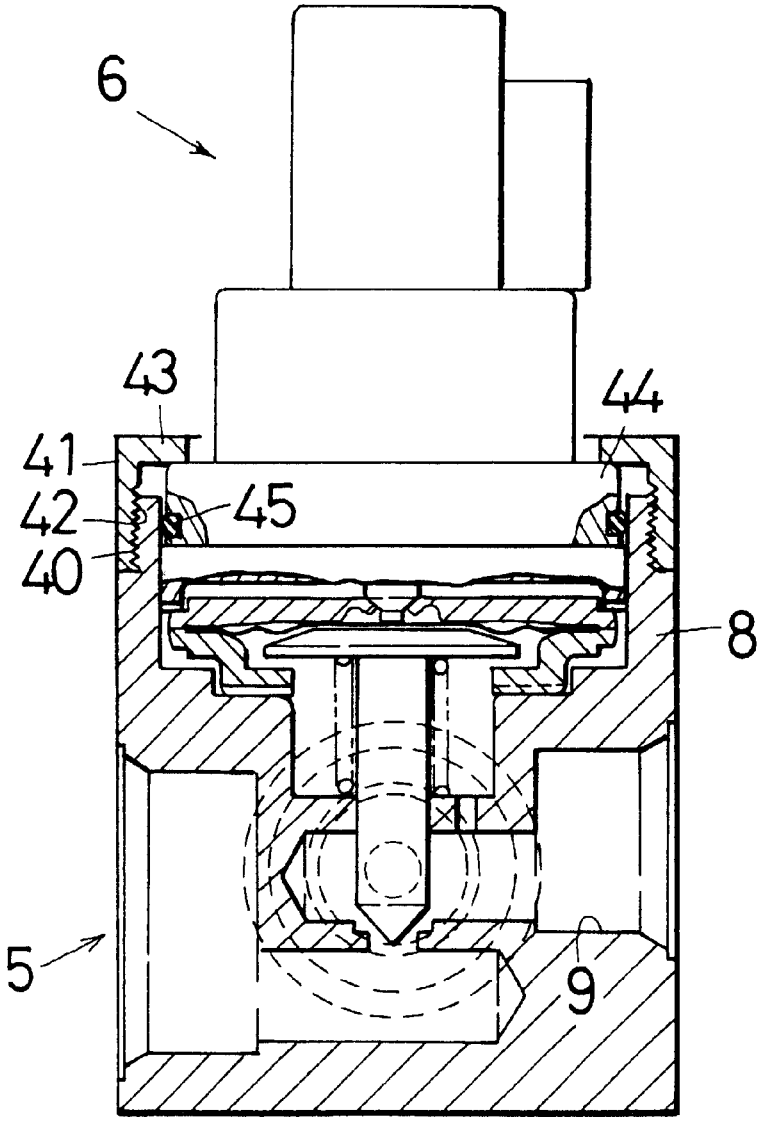
FIG. 5 is a sectional view showing a second embodiment relating to the joint between an expansion valve and a pressure detector.

FIG. 5 shows a second embodiment relating to the joint between the supercooling control expansion valve 5 and the pressure detector 6. The second embodiment is basically the same as the above-described first embodiment in terms of the arrangement in which the refrigerant is taken into the block 8 to control the flow rate of the refrigerant, and the refrigerant passing through the block 8 is introduced to a sensor element (not shown) to detect the pressure of the refrigerant. The first and second embodiments differ from each other in the method of joining together the supercooling control expansion valve 5 and the pressure detector 6 into one unit.

In the second embodiment, a screw-in joining method is employed. More specifically, an external thread 40 is formed on a cylindrical portion of the top (as viewed in the figure) of the block 8. A nut 41 with an internal thread 42 is screwed onto the threaded portion of the block 8 so that the internal thread 42 is engaged with the external thread 40. After the pressure detector 6 has been inserted into the block 8, the internal thread 42 of the nut 41 is engaged with the external thread 40 of the block 8. Consequently, a collar portion 43 of the nut 41 presses a step portion 44 of the casing of the pressure detector 6, thereby fixing the pressure detector 6 to the block 8.

This structure allows disassembly and is therefore convenient for the replacement of parts and an inspection operation. Although an O-ring 45 is also inserted in the vicinity of the thread engagement portion to maintain the gas-tight condition in the second embodiment, where the O-ring 45 is provided is not necessarily limited to the described position. It should be noted that the means for maintaining the gas-tight condition is not necessarily limited to the O-ring 45. For example, sealing tape of a synthetic resin material or a two-part curing type liquid sealing compound may be interposed in the area of engagement between the external thread 40 and the internal thread 42 and in the area of contact between the collar portion 43 and the step portion 44.

(Third Embodiment)

Figure 6:
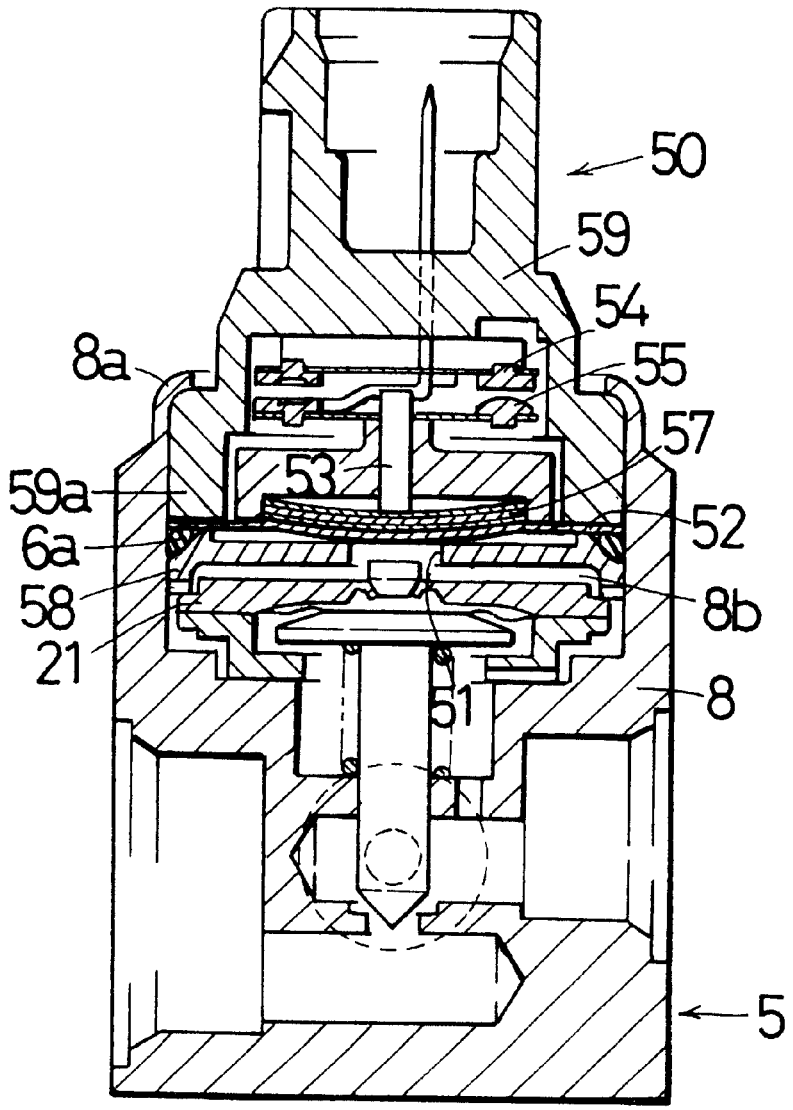
FIG. 6 is a sectional view of a third embodiment relating to a pressure detector, showing an example of a dual-action contact type pressure switch.

FIG. 6 shows a third embodiment relating to a pressure detector that detects the pressure of the refrigerant with a mechanically operating pressure switch, not with a pressure sensor such as a semiconductor pressure sensor. The pressure detector 50 shown in FIG. 6 is based on a conventionally known pressure switch capable of dual-action control, which is disclosed in Japanese Patent Post-Exam Publication No. Hei 7-101583. The pressure detector 50 is joined to the supercooling control expansion valve 5 into one unit. A diaphragm 52 is pressed by a diaphragm support member 58 and an O-ring 6*a* against the end face (lower surface as viewed in FIG. 6) of an end portion 59*a* at the outer periphery of a casing 59 of the pressure detector 50 and thus held fixedly therebetween.

In other words, the O-ring 6*a* is provided between the outer peripheral portion of the diaphragm support member 58 and the end portion 59*a* of the casing 59. The outer peripheral portion of the diaphragm support member 58 abuts against the outer periphery of the diaphragm holding member 21. In this way, the diaphragm support member 58 is supported by the diaphragm holding member 21. Accordingly, the gas-tightness of the passage space 8*b* is maintained by the O-ring 6*a*. The supercooling control expansion valve 5 has the same arrangement and function as in the case of the foregoing embodiment.

The refrigerant sent from the passage space 8*b* of the supercooling control expansion valve 5 is introduced into an opening 51 of the diaphragm support member 58 to press the diaphragm 52 by the pressure of the refrigerant. When the diaphragm 52 is deformed, an actuating rod 53 and so forth are pressed through a snap disk 57 placed in contact with the diaphragm 52, thus performing an operation such as cutting off the contact between contacts 54 and 55 provided inside the casing 59. That is, it is possible to perform a dual-action control such that when the refrigerant pressure in the refrigerating cycle is within a normal pressure range, the pressure switch is set in an ON state, whereas when the refrigerant pressure is lower or higher than the normal pressure range, the pressure switch is set in an OFF state.

(Fourth Embodiment)

Figure 7:
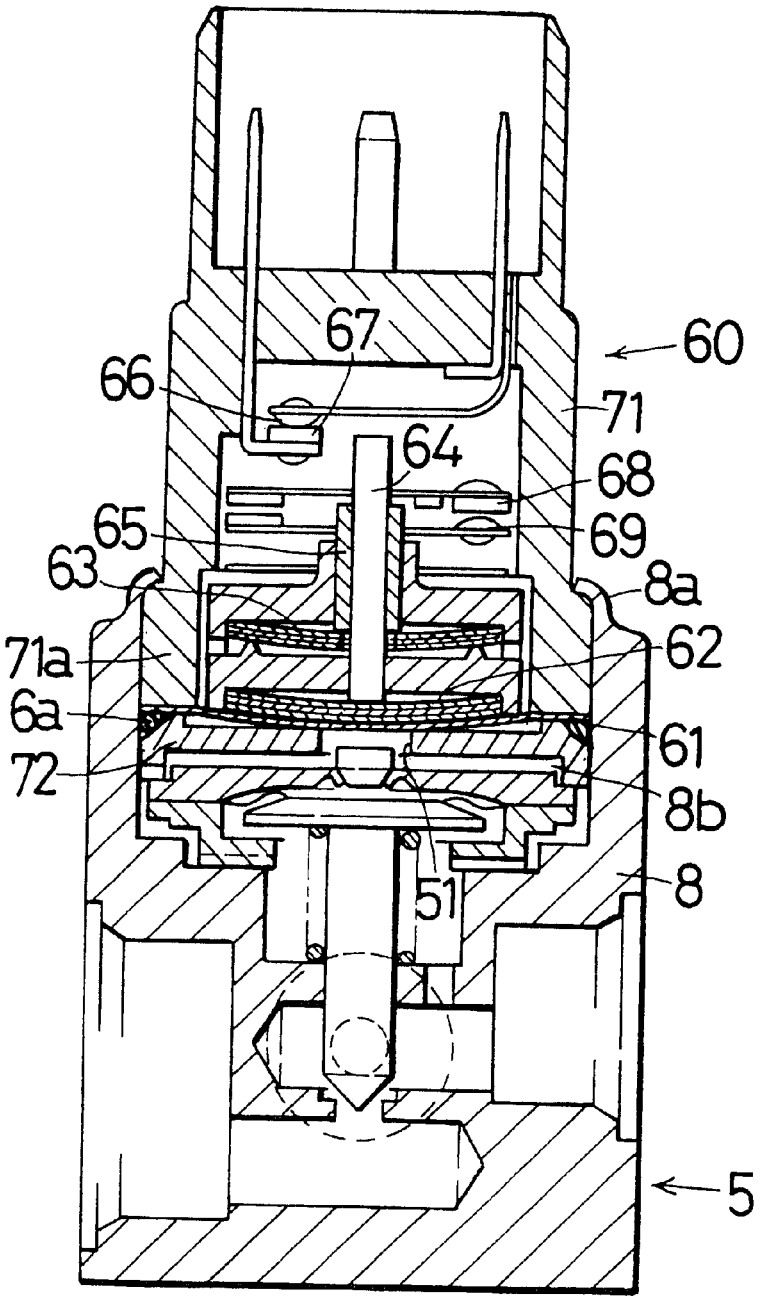
FIG. 7 is a sectional view of a fourth embodiment relating to a pressure detector, showing an example of a triple-action contact type pressure switch.

FIG. 7 shows a fourth embodiment relating to a pressure detector. In the fourth embodiment, a conventionally known contact type pressure switch capable of triple-action control, which is disclosed in Japanese Patent Post-Exam Publication No. Hei 7-114094, is joined to the supercooling control expansion valve 5 into one unit. In FIG. 7, a pressure detector 60 based on a pressure switch capable of triple-action control is joined to the supercooling control expansion valve 5 into one unit.

The refrigerant sent from the passage space 8*b* of the supercooling control expansion valve 5 is introduced into an opening 51 of the pressure detector 60 to drive a diaphragm 61. When the diaphragm 61 is driven, a snap disk 62 placed in contact with the diaphragm 61 is pressed. When the snap disk 62 is pressed, a snap disk 63 is pressed in response to the pressing of the snap disk 62.

The diaphragm 61 is supported between an O-ring 6*a* and an end portion 71*a* of a casing 71 of the pressure detector 60 in the same way as in the third embodiment shown in FIG. 6. The O-ring 6*a* is disposed between the end portion 71*a* of the casing 71 and a diaphragm support member 72 to maintain the gas-tightness of the passage space 8*b*. Accordingly, when the diaphragm 61 is driven by the pressure of the refrigerant from the passage space 8*b*, actuating rods 64 and 65 are activated through the snap disks 62 and 63. The actuating rods 64 and 65 as activated perform an operation such as cutting off the contact between contacts 66 and 67 or the contact between contacts 68 and 69.

Thus, it is possible to perform a triple-action control in which ON-OFF control of a fan motor for the condenser 3, for example, is added to the dual-action control in which when the refrigerant pressure in the refrigerating cycle is within a normal pressure range, the pressure switch is set in an ON state, whereas when the refrigerant pressure is lower or higher than the normal pressure range, the pressure switch is set in an OFF state. The fourth embodiment also adopts a caulking method wherein the thin-walled distal end portion 8*a* of the block 8 is deformed with a caulking tool as a means for joining together the supercooling control expansion valve 5 and the pressure detector 60. Although four embodiments have been detailed above, the present invention is not necessarily limited to the foregoing embodiments but may also be applied to other arrangements.

As has been detailed above, the pressure detector is integrally incorporated into the supercooling control expansion valve. Therefore, the expansion valve unit having a pressure detecting function becomes compact in size as a whole, and the number of man-hours needed for manufacture reduces. Thus, it is possible to provide an expansion valve unit having a pressure detecting function at reduced cost.

What is claimed is:

1. An expansion valve unit having a pressure detecting function, comprising:

a supercooling control expansion valve disposed in a flow path of a refrigerant sent into an evaporator of a refrigeration system constituting a refrigerating cycle to control a flow rate of the refrigerant;

a pressure detector provided at one end of the supercooling control expansion valve to detect a pressure of the refrigerant sent thereto through a refrigerant passage in said supercooling control expansion valve;

joining means for integrally joining said pressure detector to said supercooling control expansion valve;

a hermetic seal member disposed near a joint between said supercooling control expansion valve and said pressure detector to prevent leakage of the refrigerant; and a hermetically sealed space formed in a block constituting a base body of said supercooling control expansion valve, said hermetically sealed space surrounding a flow rate control member incorporated in said supercooling control expansion valve, and said hermetically sealed space communicating with said refrigerant passage.

2. An expansion valve unit having a pressure detecting function, comprising:

a supercooling control expansion valve disposed in a flow path of a refrigerant sent into an evaporator of a refrigeration system constituting a refrigerating cycle to control a flow rate of the refrigerant;

a pressure detector provided at one end of the supercooling control expansion valve to detect a pressure of the refrigerant sent thereto through a refrigerant passage in said supercooling control expansion valve;

joining means for integrally joining said pressure detector to said supercooling control expansion valve;

a hermetic seal member disposed near a joint between said supercooling control expansion valve and said pressure detector to prevent leakage of the refrigerant;

a power element chamber provided in a block constituting a base body of said supercooling control expansion valve, said power element chamber being defined by a diaphragm and having a refrigerant sealed therein to control a degree of opening of a valve element of said supercooling control expansion valve;

a first space formed adjacently to said power element chamber, said first space communicating with said refrigerant passage, wherein said first space is filled with a high-temperature and high-pressure refrigerant and disposed closer to said pressure detector than said power element chamber; and a second space formed adjacently to said first space on a side thereof closer to said pressure detector;

wherein said pressure detector is disposed between said first space and said second space to detect a pressure of the high-temperature and high-pressure refrigerant on a basis of a pressure difference between said first space and said second space.

3. An expansion valve unit having a pressure detecting function according to claim 1 or 2, wherein said hermetic seal member is an O-ring for sealing a gap between said pressure detector and said block.

4. An expansion valve unit having a pressure detecting function according to claim 1 or 2, wherein said pressure detector detects the pressure of the refrigerant with a pressure detecting device comprising a semiconductor device.

5. An expansion valve unit having a pressure detecting function according to claim 1 or 2, wherein said pressure detector detects the pressure of the refrigerant with a contact type pressure switch.

6. An expansion valve unit having a pressure detecting function according to claim 1 or 2, wherein said joining means is caulking whereby said block is plastically deformed.

7. An expansion valve unit having a pressure detecting function according to claim 1 or 2, wherein said joining means is thread coupling wherein said pressure detector is fixed to said supercooling control expansion valve by thread engagement.

8. An expansion valve unit having a pressure detecting function according to claim 7, wherein said thread coupling fixes said pressure detector to said block by engagement between a nut having an internal thread and an external thread provided on an outer periphery of said block.

* * * * *